United States Patent [19]

Bracken

[11] 4,094,613

[45] June 13, 1978

[54] VARIABLE OUTPUT CENTRIFUGAL PUMP

[75] Inventor: Robert L. Bracken, Rockford, Ill.

[73] Assignee: Sundstrand Corporation, Rockford, Ill.

[21] Appl. No.: 684,335

[22] Filed: May 7, 1976

[51] Int. Cl.[2] ..... F01B 25/04; F01D 17/08; F04D 29/44

[52] U.S. Cl. ..... 415/17; 415/158; 251/282

[58] Field of Search ..... 415/157, 158, 203, 204, 415/211, 49, 219 C, 17; 91/415; 251/31, 282; 417/310

[56] References Cited

U.S. PATENT DOCUMENTS

| | | | |
|---|---|---|---|
| 2,341,871 | 2/1944 | Karrer | 415/219 C UX |
| 2,435,836 | 2/1948 | Johnson | 415/158 UX |
| 2,786,420 | 3/1957 | Kenney | 415/157 UX |
| 3,784,318 | 1/1974 | Davis | 415/158 |
| 3,893,785 | 7/1975 | Maron | 415/157 |

FOREIGN PATENT DOCUMENTS

| | | | |
|---|---|---|---|
| 719,458 | 4/1942 | Germany | 415/158 |
| 133,892 | 3/1931 | Switzerland | 415/158 |
| 309,294 | 10/1955 | Switzerland | 415/219 C |
| 559,840 | 3/1944 | United Kingdom | 415/219 C |

*Primary Examiner*—Carlton R. Croyle
*Assistant Examiner*—Donald A. Holland
*Attorney, Agent, or Firm*—Ted F. Killingsworth; William R. Peoples; Michael B. McMurry

[57] ABSTRACT

A centrifugal pump includes a housing containing an impeller mounted on a shaft which is journaled for rotation within the housing. An inlet to the housing directs fluid from a supply to one end of the impeller and axially spaced first and second volute diffusers formed around the other end of the impeller receive fluid from the impeller. The volute diffusers are of different predetermined sizes designed to handle different flowrates of fluid while producing about the same pressure head. A sleeve telescoped into the housing and surrounding the impeller may be moved between extended and retracted positions to close off and open the flow of fluid into the larger one of the volute diffusers.

5 Claims, 6 Drawing Figures

VARIABLE OUTPUT CENTRIFUGAL PUMP

BACKGROUND OF THE INVENTION

This invention relates generally to a centrifugal pump and, more particularly, to a centrifugal pump of the type having a variable output flow capacity and such as might be used as a fuel pump in an aircraft.

In supplying fuel to the engine of an aircraft, it is desirable to keep the temperature rise in the fuel passing through a fuel pump to a minimum for both high flow and low flow fuel requirements. As is disclosed in U.S. Pat. No. 3,784,318, issued to Donald Y. Davis, one way of accomplishing this in a centrifugal pump having diffuser vanes is to provide a shutter valve for closing off selected ones of the diffuser passages defined by the vanes. It will be appreciated, however, that with this type of pump operating at a low flow discharge, an undesirable pulsing flow of fluid may be introduced into the pumping system downstream of the impeller because of the closing off of several of the diffuser passages. Moreover, the precise machining required for the vanes and the complicated assembly of the vanes in the pump housing makes this type of pump quite expensive to produce.

Another centrifugal pump including a shutter valve for producing a variable flow discharge is disclosed in U.S. Pat. No. 3,826,586. The pump disclosed in this patent apparently utilizes a volute type diffuser instead of vane diffusers. The variable flow is produced by restricting the flow from the impeller tip into the volute surrounding the impeller through the use of a shutter valve of similar construction to the valve disclosed in the Davis patent. By restricting the output flow of the fluid from the impeller into the volute in this manner, however, turbulence may be introduced in the fluid, causing losses in the conversion of velocity head into pressure head. As a result, at lower flowrates, the discharge pressure may not reach the magnitudes desired for proper operation of the aircraft engine, and the efficiency of the pump may be impaired substantially.

SUMMARY OF THE INVENTION

The general object of the present invention is to provide a variable output centrifugal pump which is lighter in weight, less expensive and smoother in operation than prior similar pumps. More specifically, the object of the present invention is to achieve the foregoing while keeping the temperature rise of the fluid passing through the pump to a minimum for low volume flow without a sacrifice in the discharge pressure of the fluid. Advantageously, this is achieved in the exemplary pump through the provision of at least two axially spaced volute diffusers operable in conjunction with a common impeller, with each volute being sized to operate most efficiently at a particular flowrate while producing about the same pressure head in the discharge fluid regardless of whether fluid flows through only one or both of the volutes.

The invention also resides in the novel manner of utilizing the input and output pressures of the fluid to shift means in the form of a sleeve into an operative position to close off one of the diffusers so the pump produces a low flowrate of discharge fluid at approximately the same pressure head as if both diffusers were open to provide a high flowrate of discharge fluid.

These and other objects and advantages of the present invention will become more apparent from the following detailed description when taken in conjunction with the accompanying drawings.

DETAILED DESCRIPTION OF THE PREFERRED EMBODIMENT

Figure 1:
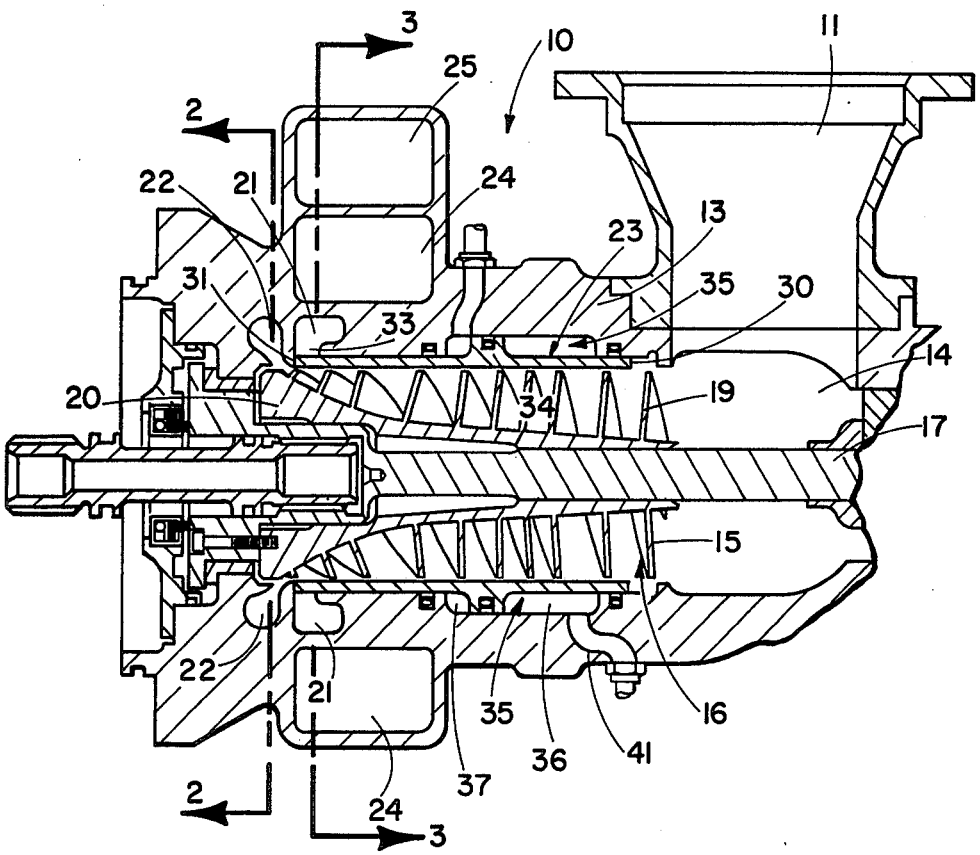
FIG. 1 is a fragmentary, cross-sectional view of a centrifugal pump embodying the novel features of the present invention.

As shown in the drawings for purposes of illustration, the present invention is embodied in a centrifugal pump 10 particularly adapted for use as fuel pump to supply fuel to the engine of an aircraft. Typically, fluid enters the pump at one flowrate and pressure head through an inlet 11 from a supply (not shown) and is discharged from the pump at an increased pressure head to flow through conduits (not shown) to the engine for combustion. More particularly, the fluid enters a pump housing 13 through the inlet and flows into an inlet chamber 14 which communicates with one end 15 of an impeller 16. The latter is mounted for rotation with a shaft 17 which is journaled within the housing and ultimately driven by the aircraft engine. From the inlet chamber the fluid flows in a generally axial direction through the impeller, being accelerated by the blades 19 of the impeller and eventually leaving the impeller at an accelerated velocity from the opposite end 20 of the impeller in a generally radial direction. In flowing from the impeller, the fluid passes through diffuser means which convert at least some of the velocity head of the fluid into pressure head and, from the diffuser means, fluid is discharged from the pump through the aforementioned conduits to the aircraft engine for combustion.

In passing from the pump 10 to the aircraft engine, some of the fluid may be used as a coolant for various accessories of the aircraft, thereby causing an increase in the temperature of the fluid arriving at the engine. In addition to the heat added to the fuel from the aircraft accessories, heat also is added to the fuel by operation of the pump. At high discharge flowrates for the pump, e.g. 250 gpm, the amount of heat added does not significantly affect the character of the fuel because the pump, typically, is designed to operate efficiently without substantial heat losses to the fuel. But, at low discharge flowrates of about the same pressure head, e.g. 2–4 gpm, such as when the aircraft is at flight idle, inefficiently in pumping may generate enough heat in the fuel so that when combined with the heat added by the aircraft accessories the fuel becomes unstable, tending to coke and decompose. This, of course, is undesirable, and one solution to the problem as taught by the aforementioned U.S. Pat. No. 3,784,318 is to utilize a vane-type diffuser incorporating means for selectively closing off some of the diffuser passages in the pump when discharge flow demand is low. With this approach, however, an additional problem arises in that a pulsing flow of fluid may be created when a substantial number of the vane diffuser passages are closed off. Moreover, where weight and manufacturing costs are important, it may be more desirable to utilize a centrifugal pump employing volute-type diffuser means rather than vane-type diffuser means. In this regard, U.S. Pat. No. 3,826,586 discloses a pump which incorporates volute diffuser means and closure means for selectively restricting the flow of fluid from the pump impeller into such diffuser. While the closure means disclosed in this latter patent may be effective to reduce the flowrate of the discharge fluid from the pump to the demanded low flowrate, the obstruction and turbulence caused by the closure means may also reduce the pressure head of the low flow discharge fluid so that the pressure head of the discharge fluid is less than that which is desired.

In accordance with the primary aspect of the present invention, the exemplary pump 10 is constructed in a novel manner so as to provide a smoothly flowing discharge at low flowrates while keeping the fluid temperature rise across the impeller 16 at a minimum and without a sacrifice in the discharge pressure head as compared to the discharge pressure head for fluid discharged at a high flowrate. For these purposes, two axially spaced volute diffusers 21 and 22 are formed around the outlet end portion of the impeller to receive the fluid flowing from the impeller. With the demand for a low flowrate discharge from the pump, closure means 23 blocks the flow of fluid into one of the volute diffusers, thereby reducing the discharge flowrate by the amount which otherwise would be provided by the closed volute diffuser. Advantageously, the pressure head of the fluid discharged from either volute diffuser is about the same, so that, by closing off one of the volute diffusers, no effective change is seen in the pressure head of the discharge fluid of the pump even though the flowrate may be reduced considerably. Moreover, with the volute-type diffuser means, a smooth and continuous flow of discharge fluid from the pump is assured while also providing a lighter weight and less expensive pump.

Figure 2:
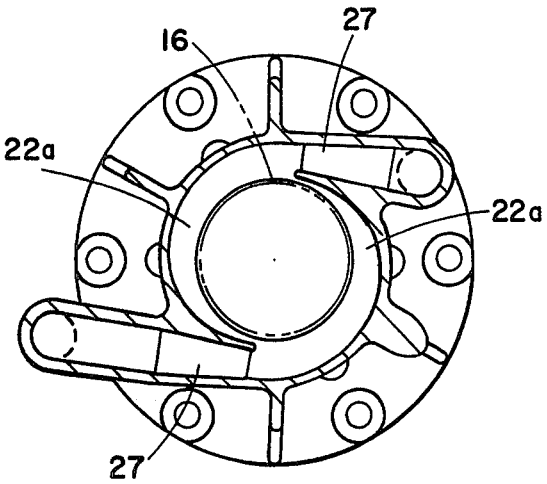
FIGS. 2 and 3 are cross-sectional views taken substantially along lines 2—2 and 3—3, respectively, of FIG. 1.
Figure 3:
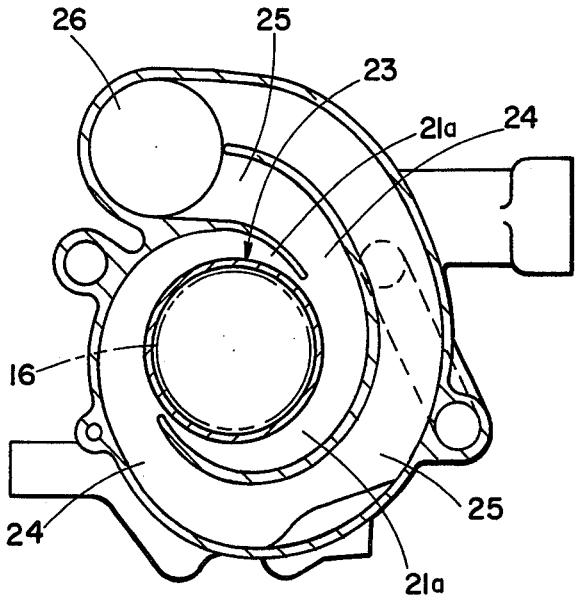

In the present instance, the volute diffusers 21 and 22 are integrally formed with the housing 13 and each volute diffuser is designed to handle fluid to produce a specific increase in the pressure head of the fluid output from the impeller 16, but not necessarily at the same flowrate. Herein, for instance, the volute diffuser 21 is larger in size than the volute diffuser 22 and is sized to handle most efficiently a flowrate of approximately 190 gpm, while the volute diffuser 22 is sized to handle most efficiently a flowrate of approximately 60 gpm. As shown in FIG. 3, for balance and compactness, each volute diffuser includes two volutes angularly spaced from each other approximately 180° with each volute being provided with a discharge outlet. In particular, the larger volutes 21*a* are provided with discharge outlets 24 communicating by means of parallel conduits 25 with a common outlet pipe 26 from the pump. Similarly, the smaller volutes 22*a* are provided with discharge outlets 27 (see FIG. 2) communicating with a second outlet pipe 29 (see FIG. 4) from the pump 10.

Figure 5:
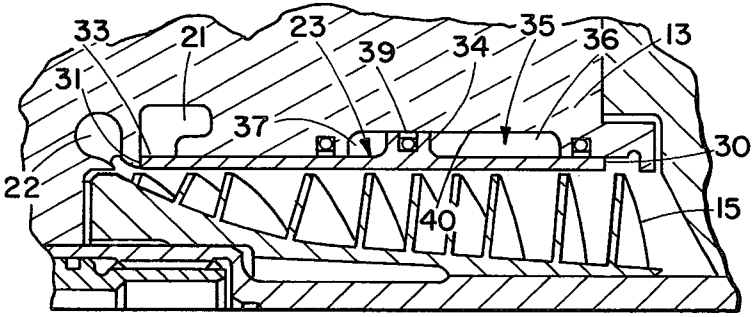
FIG. 5 is an enlarged, fragmentary, cross-sectional view of a portion of the pump shown in FIG. 1.
Figure 6:
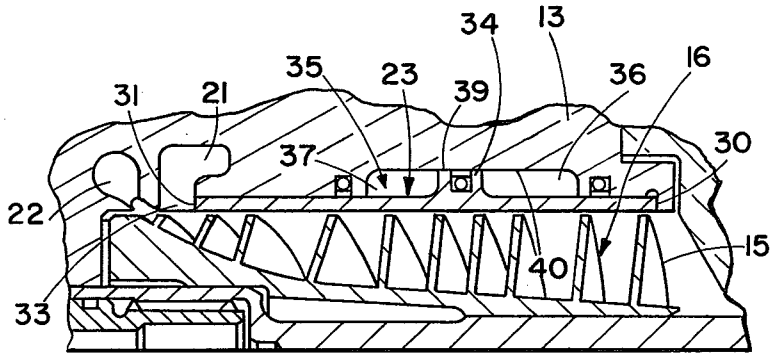
FIG. 6 is a cross-sectional view similar to FIG. 5 but showing parts of the pump in moved positions.

As shown in FIGS. 1, 5, and 6, the means for closing off the larger volute diffuser 21 includes a generally cylindrical sleeve 23 telescoped into the pump housing 13 over the impeller 16. Opposite end surfaces 30 and 31 of the sleeve communicate, respectively, with the inlet chamber 14 and an annular passageway 33 located between the outlet end portion of the impeller and the larger volute. Integrally formed with the sleeve intermediate the opposite ends thereof is an annular flange 34 projecting radially outward from the sleeve and into an annular cavity 35 formed in the housing around the impeller. The flange divides the cavity into two pressure chambers 36 and 37 which are selectively pressurized by inlet and discharge fluid to shift the sleeve between an extended position closing off the passageway 33 to the larger volute 21 and a retracted position opening the passageway (compare FIGS. 5 and 6). To keep fluid from leaking between the two pressure chambers, a peripheral sealing member 39 in the form of an O-ring is located in the outer end of the flange to engage an axially extending sidewall 40 of the cavity 35.

Figure 4:
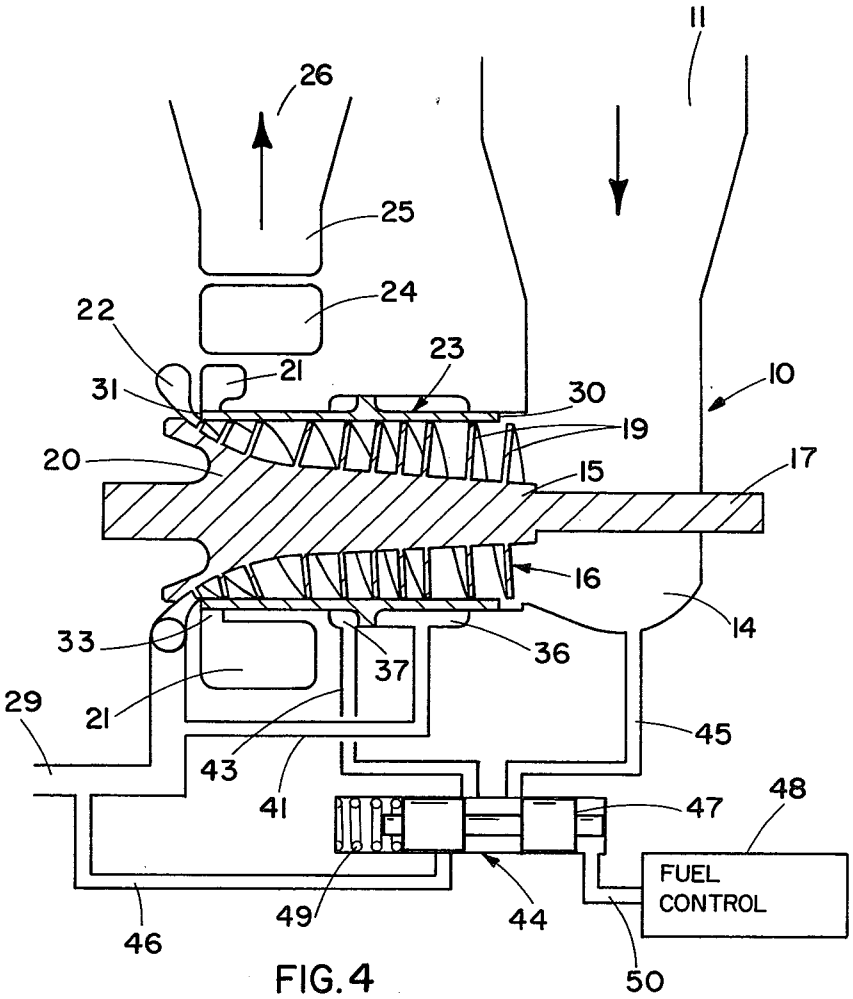
FIG. 4 is a schematic view of the pump.

For pressurizing the pressure chambers 36 and 37, a passage 41 (see FIG. 4) extends between the chamber 36 (which is located closest to the pump inlet chamber 14) and the outlet pipe 29, containing discharge fluid from the smaller diffuser 22. In this way, during normal operation of the pump 10, the chamber 26 is maintained at the discharge fluid pressure regardless of whether the passageway 33 to the larger volute diffuser is opened or closed by the sleeve 23. Means for selectively pressurizing the other chamber 37 include another passage 43 communicating between that chamber and a control valve 44 which serves to provide fluid to the chamber 37 at either inlet pressure or discharge pressure. As shown in FIG. 4, passages or lines 45 and 46 communicate with the valve from the inlet chamber 14 and the discharge conduit 29, respectively, and a valve spool 47 may be shifted axially to place either of these lines in communication with the passage 43 leading to the chamber 37. With a demand for a low flowrate discharge, a spring 49 within the control valve normally biases the spool against the opposite end of the valve bore into a position so that fluid at inlet pressure is supplied to the chamber 37. This results in a pressure differential across the flange 34 so that the sleeve is held in its operative position with the passageway 33 closed. As the demand for fluid is increased, requiring a high flowrate discharge, a pressure signal from a fuel control 48 for the aircraft is supplied through a line 50 against the end of the spool opposite the spring to overcome the force of the spring and shift the spool (to the left in FIG. 4), placing the chamber 37 in communication with the fluid at discharge pressure through line 46 and passage 43 while at the same time cutting off the flow of fluid at inlet pressure through the valve. To shift the spool back again, the pressure signal is terminated by the fuel control so that the spring 49 then urges the spool back to the right.

With the valve spool 47 shifted to the left, both chambers 36 and 37 are pressurized to discharge pressures. In order for the sleeve 23 to be shifted to open the passageway 33 so the fluid from the impeller 16 may flow into the larger volute 21, advantage is taken of the difference in fluid pressures acting on the opposite end surfaces 30 and 31 of the sleeve. As previously mentioned, the inlet end surface 30 of the sleeve is in communication with the inlet chamber 14 and the outlet end 31 of the sleeve communicates with fluid substantially at discharge pressure. With this arrangement, the fluid at inlet pressure acts against that end of the sleeve, urging it toward its operative position while the fluid at discharge pressures acts against an equivalent surface area urging the sleeve toward its inoperative position. The forces acting on the ends of the sleeve from the inlet and outlet pressures are, of course, unbalanced, with the force at the outlet end of the sleeve being substantially higher than the force acting at the inlet end of the sleeve. With the pressure in the chambers 36 and 37 balanced, the result is that the sleeve will be shifted into its retracted position. In order to assure that the sleeve will shift back into its extended position when the demand for fluid is again low, the radial surface area of each side of the flange 34 is large enough so that the difference in forces acting on opposite sides of the flange is greater than the difference in forces acting at the opposite ends of the sleeve.

In view of the foregoing, it will be appreciated that the present invention brings to the art a new and improved variable output centrifugal pump 10 which efficiently provides a low flowrate discharge without substantial increases in the temperature of the discharge fluid and while maintaining a discharge pressure head which is about the same as the pressure head at high flowrates. Advantageously, this is achieved by virtue of the unique construction of the pump with the two axially spaced volutes 21 and 22 in conjunction with the single impeller 16, while also providing a pump which is lighter in weight, smoother in operation and less expensive to manufacture than prior similar pumps.

I claim:

1. A centrifugal pump for receiving fluid at one flow rate and pressure head and discharging the fluid at an increased pressure head including, a housing, a shaft journaled for rotation within housing, an impeller within said housing and mounted on said shaft for rotation therewith, an inlet chamber within said housing for receiving fluid into said housing and directing said fluid to one end of said impeller, a first diffuser continuously communicating with the other end portion of said impeller to receive fluid discharged from said impeller, a second diffuser axially spaced from said first diffuser for selective separate communication with said other end portion of said impeller, said diffusers each being fixed to handle fluid at a specific flow rate for producing a specific pressure head, an outlet passageway between said impeller and said second diffuser, a moveable member telescoped into said housing for movement between an extended position closing off said passageway and a retracted position permitting fluid to flow from said impeller into said second diffuser, and means for biasing said member toward one of its positions including a pressure chamber communicating with said member, means for selectively pressurizing said chamber for moving said member toward said one position, said means for selectively pressurizing including a passage communicating with one of said inlet chamber and said fluid discharged from said chamber.

2. A centrifugal pump for receiving fluid at one flowrate and pressure head and discharging the fluid at an increased pressure head including, a housing, a shaft journaled for rotation within said housing, an impeller within said housing and mounted on said shaft for rotation therewith, inlet means for receiving fluid into said housing and directing said fluid to one end of said impeller, first and second diffusers axially spaced from each other and communicating with the other end portion of said impeller to receive fluid from said impeller, said diffusers each being sized to handle fluid at a specific flowrate for producing a specific pressure head, means for closing off the flow of fluid from said impeller into one of said diffusers while still permitting fluid flow into the other of said diffusers, said means for closing including an outlet passageway between said impeller and said one diffuser, a movable member telescoped into said housing for movement between an extended position closing off said passageway and a retracted position permitting fluid to flow from said impeller into said one diffuser, means for biasing said member toward its extended position, and means for overcoming said biasing means and for urging said member into its retracted position said inlet means including an inlet chamber within said housing and communicating with said one end of said impeller, said member including first and second end surfaces of substantially the same radial width and which, at least in part, define said means for biasing, said first end surface communicating with said inlet chamber whereby the inlet pressure of said fluid acts against said first end surface to urge said member toward its extended position, said second end surface communicating with the fluid flowing out of said impeller whereby the pressure of said latter fluid acts against said second surface to urge said member toward its retracted position.

3. A centrifugal pump as defined by claim 2 wherein said member comprises a sleeve telescoped over said impeller, said means for overcoming said biasing means including a cavity formed within said housing intermediate the opposite ends of said sleeve, an annular flange connected to said sleeve intermediate the opposite ends thereof and extending radially outward therefrom a distance greater than the radial width of said sleeve ends to divide said cavity into first and second pressure chambers, means for selectively pressurizing at least one of said chambers to cause said sleeve to move into its extended position.

4. A centrifugal pump as defined by claim 3 including a first passage communicating between said first pressure chamber and the fluid discharged from said other one of said diffusers so that the pressure of such discharge fluid acts against said flange to urge said sleeve toward its extended position, said means for selectively pressurzing including a control valve, a second passage communicating between said control valve and said second chamber, a third passage communicating between said control valve and said inlet chamber, a fourth passage communicating between said control valve and the fluid discharged from said other one of said volutes, means for selectively shifting said control valve to supply inlet pressure fluid or discharge pressure fluid through said second passage and to said second chamber.

5. A centrifugal pump for receiving fluid at one flowrate and pressure head and discharging the fluid at an increased pressure head including, a housing, a shaft journaled for rotation within said housing, an impeller within said housing and mounted on said shaft for rotation therewith, inlet means for receiving fluid into said housing and including an inlet chamber for directing said fluid to one end of said impeller, first and second volute diffusers axially spaced from each other and communicating with the other end portion of said impeller to receive fluid therefrom, said diffusers each being sized to handle fluid at a specific flowrate for producing a specific pressure head, and means for closing off the flow of fluid from said impeller into one of said diffusers while still permitting fluid flow into the other of said diffusers, said means for closing including an outlet passageway between said impeller and said one diffuser, a movable member telescoped into said housing for movement between an extended position closing off said passageway and a retracted position permitting fluid to flow from said impeller into said one diffuser, first and second end surfaces formed on said member, said first end surface communicating with said inlet chamber whereby the inlet pressure of said fluid acts against said first end surface to urge said member toward its extended position, said second end surface communicating with the fluid flowing out of said impeller whereby the pressure of said latter fluid acts against said second surface to urge said member toward its retracted position.

* * * * *